United States Patent [19]

Grellmann et al.

[11] Patent Number: 4,831,222

[45] Date of Patent: May 16, 1989

[54] INTEGRATED PAD SWITCH

[75] Inventors: Heinz E. Grellmann, Beaverton; Leonard A. Roland, Portland, both of Oreg.

[73] Assignee: Tektronix, Inc., Beaverton, Oreg.

[21] Appl. No.: 728,130

[22] Filed: Apr. 29, 1985

[51] Int. Cl.[4] ..... H01H 1/44

[52] U.S. Cl. ..... 200/257; 200/504; 333/106

[58] Field of Search ..... 200/257, 336, 110, 110 A, 200/17 R, 177, 267, 268, 153 S, 16 C, 16 D, 11 R, 24, 28, 292; 333/101, 105, 106, 107

[56] References Cited

U.S. PATENT DOCUMENTS

| | | | |
|---|---|---|---|
| 2,784,379 | 3/1957 | Schunemann | 333/105 |
| 3,177,305 | 4/1965 | Lehman | 200/17 R |
| 3,181,086 | 4/1965 | McCutcheon et al. | 333/107 |
| 3,651,287 | 3/1972 | Rubenstein | 200/16 C |
| 3,794,784 | 2/1974 | Snider | 200/11 DA |
| 3,969,690 | 7/1976 | Hansen et al. | 333/107 |
| 4,158,117 | 6/1979 | Quilliam et al. | 200/262 |
| 4,218,593 | 8/1980 | Mayer et al. | 200/11 DA |
| 4,249,056 | 2/1981 | MacManus | 200/17 R |
| 4,275,279 | 6/1981 | Wagatsuma et al. | 200/11 DA |
| 4,328,399 | 5/1982 | Perks et al. | 361/397 |
| 4,405,841 | 9/1983 | Van Zeeland | 200/11 DA |

FOREIGN PATENT DOCUMENTS

| | | | |
|---|---|---|---|
| 2519572 | 11/1976 | Fed. Rep. of Germany | 200/267 |
| 54-158836 | 12/1979 | Japan | 333/107 |

OTHER PUBLICATIONS

IBM Technical Disclosure Bulletin, vol. 6, No. 5, Oct. 1963, pp. 57 and 58, Increasing the Speed of Cryogenic Circuits, R. L. Garwin.

*Primary Examiner*—Henry J. Recla
*Assistant Examiner*—Linda J. Sholl
*Attorney, Agent, or Firm*—Francis I. Gray

[57] ABSTRACT

An integrated pad switch has conductive contacts that may be embedded in a flexible substrate to form a wiper contact. The flexible substrate is backed by a foamed elastic block and mounted on a driver. The wiper contact moves across the surface of a hybrid circuit substrate having an electrical circuit to provide the desired switching function.

7 Claims, 3 Drawing Sheets

INTEGRATED PAD SWITCH

BACKGROUND OF THE INVENTION

1. Field of the Invention

The present relates to microwave switches, and more particularly to an integrated pad switch that switches on a planar transmission media over the frequency range from DC to over 40 GHz.

2. Description of the Prior Art

Current switches used in microwave applications are of the suspended contact coaxial type, coaxial turret type, or of the slab-line type shown in FIGS. 1 and 2. These slab-line switches consist of a contact 10 which is essentially cantilever-mounted in a cavity 12. The end of the contact is physically moved to make contact between either an integrated circuit hybrid 14 or a metal contact 16, to select between a resistive network and a through path, for example. the electric field 18 exists between the sides of the contact and the walls of the cavity. Thus, the clearance between such walls and the contact edges is critical, and due to tolerance buildups this type of switch has a practical upper frequency limit of approximately 26 GHz.

The suspended contact coaxial type switches are generally solenoid-operated, push-pull mechanisms which move a spring-loaded contact to make or break a circuit. These switches have an upper frequency limit due to SWR and return loss, and are restricted by the practical limit of the cavity dimensions.

The coaxial turret type switches have a cylindrical attenuator between two coaxial inputs. The attenuator rotates to switch circuits between the two coaxial inputs. This switch has ground path problems.

What is desired is a microwave switch which does not have the frequency limitations of the prior swtiches, and can operate at 40 GHz or better.

SUMMARY OF THE INVENTION

Accordingly, the present invention provides an integrated pad switch with contacts that may be embedded in a flexible substrate to form a wiper contact. The substrate is backed by an elastic material and connected to a driver. The wiper contacts make contact with a planar hybrid substrate board having an electrical circut thereon. The movement of the driver causes the wiper contacts to slide to different positions on the hybrid circuit substrate to provide the switching function.

The objects, advantages and other novel features of the present invention will be apparent from the followig detailed description when read in conjunction with the appended claims and attached drawings.

DESCRIPTION OF THE PREFERRED EMBODIMENT

Figure 1:
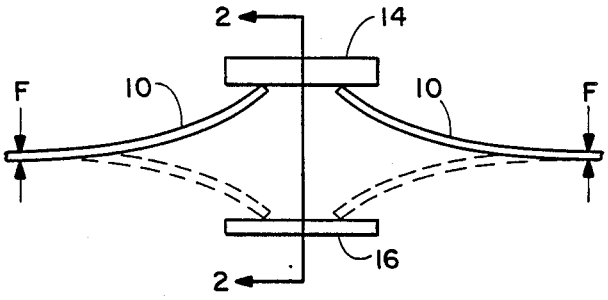
FIG. 1 (PRIOR ART)
FIG. 1 is a side plan view of a prior art slab-line switch.
Figure 2:
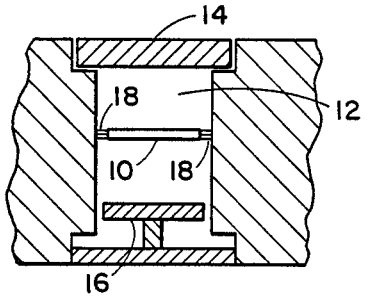
FIG. 2 (PRIOR ART)
FIG. 2 is a cross-sectional view of the slab-line switch of FIG. 1 taken along the line 2—2.
Figure 3:
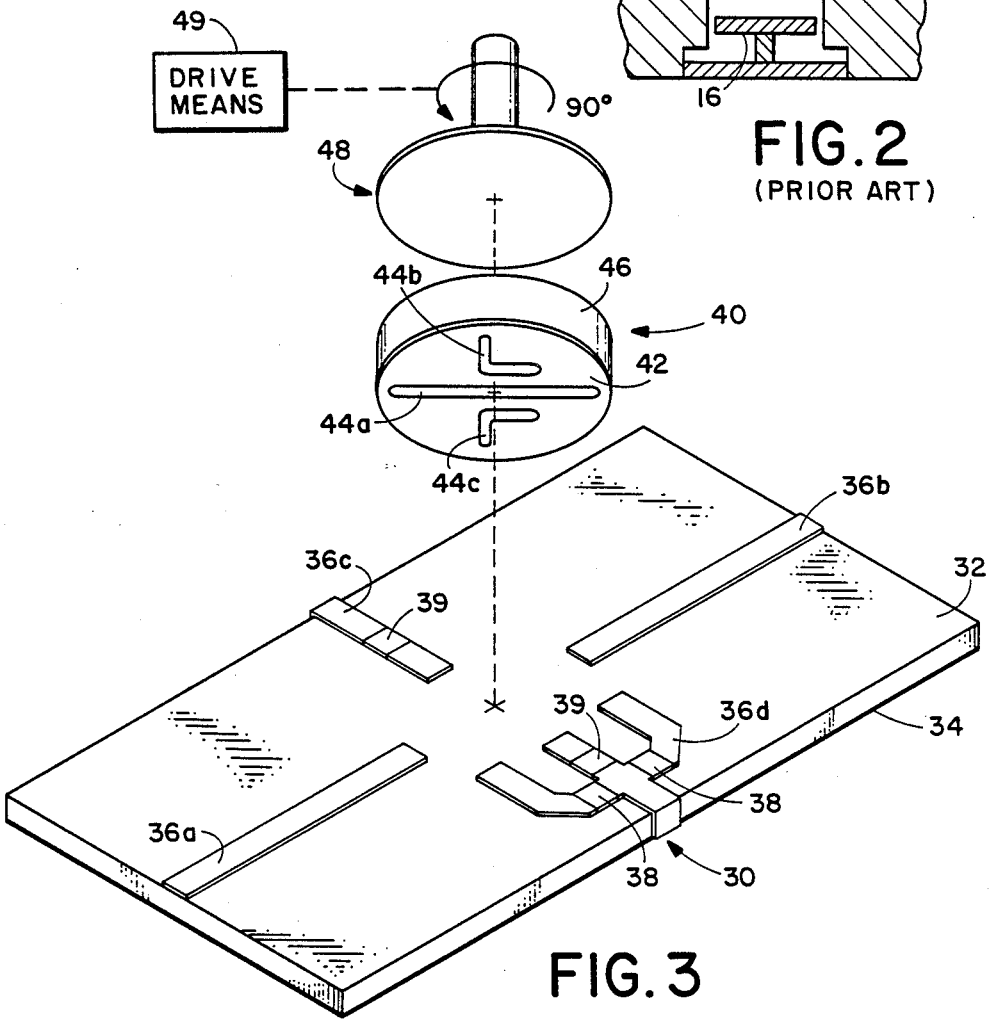
FIG. 3 is an exploded perspective view of one embodiment of an integrated pad switch according to the present invention.

Referring now to FIG. 3 a housing, or RF cavity, 30 is shown having a substrate 32 with a ground plane 34 on the back of the substrate. One the substrate 32 are laid one or more microstrip lines 36 in a desired pattern. For example line 36*a* may be an input line, line 36*b* an output line, line 36*c* a ground line connected over the edge of the substrate 32 to the ground plane 34, and line 36*d* an attenuator network including resistors 38. The substrate 32 is an insulator, such as quartz, glass, sapphire or the like which have smooth surfaces, and the microstrip lines 36 and ground plane 34 are of conducting material such as gold or the like. Termination resistors 39 are inserted to help side to side isolation.

The contact portion 49 if the switch has a flexible substrate 42 upon which is laid or embedded one or more contact strips 44 in a desired pattern. The contact strips 44 are of a conductive material, such as gold or the like. The flexible substrate 42 is an organic material, such as polyimide or the like, with the contact strips 44 preferably embedded in the substrate as described in co-pending U.S. patent application Ser. No. 703,066, filed Feb. 19, 1985 now U.S. Pat. No. 4,650,545 by Reagan et al. entitled "Ployimide Embedded Conductor Process." The flexible substrate 42 is adhesively mounted by conventional means to a foamed elastic block 46 having a low dielectric constant, such as silicone-rubber, polyurethane, cross-linked polyethylene, neoprene, vinyl nitrile, ethylene-vinyl acetate, ensolite, or the like. The resulting contact portion 40 is then adhesively attached to a driver 48 by conventional means. The driver 48 is driven by conventional means 49, such as push-pull solenoids, stepper motors, cams, dc motors with gears, or the like, to cause the contact strips 44 to move with respect to the microstrip lines 36 on the hybrid substrate 32.

Figure 4A:
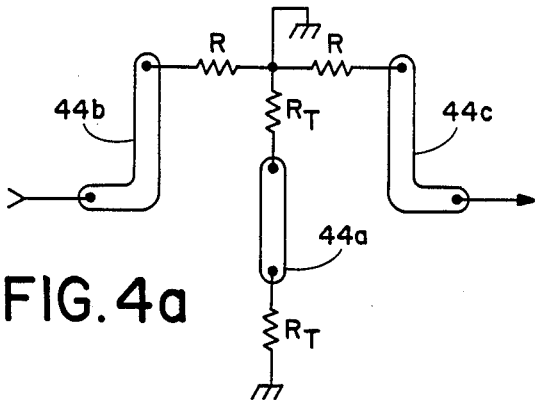
FIGS. 4*a* and 4*b* are equivalent electrical schematic views for the switch of FIG. 3.
Figure 4B:
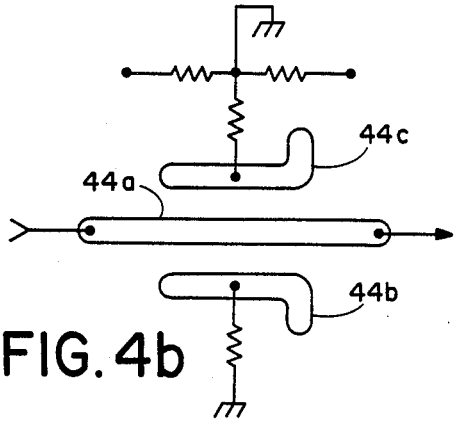

In the illustrated embodiment a rotary switch is shown, with the electrical schematic equivalent shown in FIGS. 4*a* and 4*b*. The contacts 44 slide across the microstrips 36 and either provide a direct through path from line 36*a* to 36*b* via contact 44*a*, or insert an attenuator network between the input and output by connecting the central leg of line 36*d* to line 36*c* via contact 44*a* and one end of line 36*d* to output line 36*b* via contact 44*c* and the other end of line 36*d* to input line 36*a* via contact 44*b*. The flexibility of the contact substrate 42 coupled with the resilience of the elastic block 46 serve to keep the contacts 44 in contact with the microstrip lines 36, creating a wiping action and also protecting the contacts from debris. Since there are not abrupt transitions and the switching takes place in the microstrip environment, insertion and reflection losses are kept to a minimum. The tolerances for the microstrip electric field can be kept much closer since the electric field exists between the conductors 36 and the ground plane 34 which is essentially constant. Also photolithography techniques in the manufacturing process achieve extremely tight tolerances with small contacts and the microstrip conductors.

Figure 6:
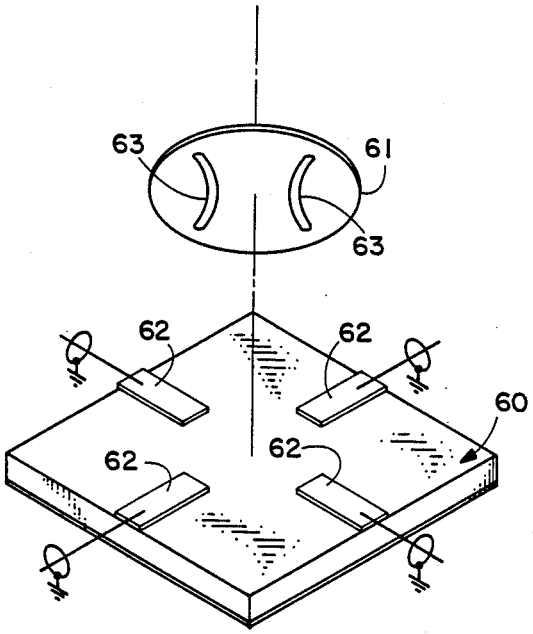
FIG. 6 is an exploded perspective view of a third embodiment of an integrated pad swsitch according to the present invention.
Figure 5:
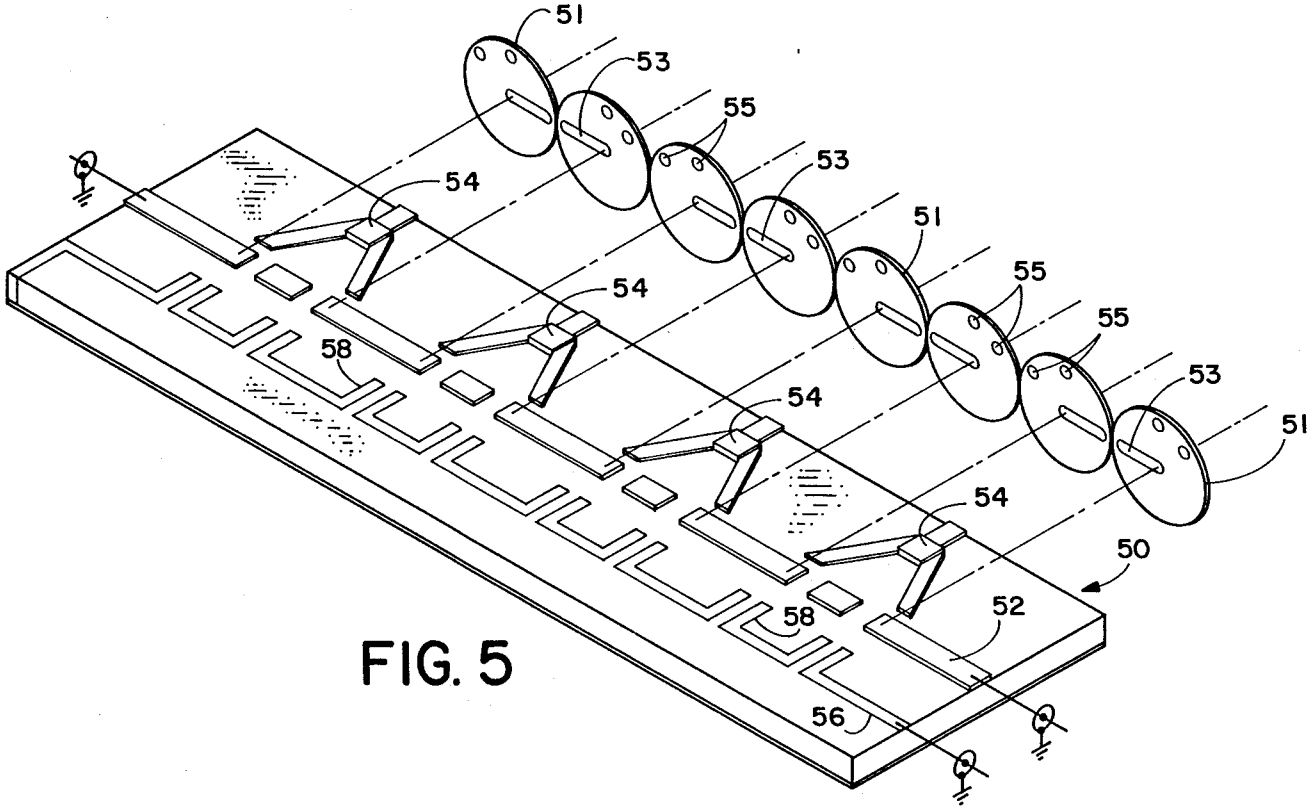
FIG. 5 is an exploded perspective view of a second embodiment of an integrated pad switch according to the present invention.

As shown in FIGS. 5 and 6 other switching function configurations may be accommodated. In FIG. 5 a hybrid substarte 50 has an interrupted microstrip throughline 52 and a plurality of attenuator networks 54. Also on the hybrid substrate 59 is an optional detection line 56. A plurality of contact circuits 51 have a radial strip 53 and a pair of contact dots 55. The contact circuits 51 are rotated into one of two positions in pairs. One position is to complete the microstrip throughline 52, and the second position is to connect an attenuator network 54 to the throughlne 52. Thus, any one or more of the attenuator networks 54 can be switched into the throughline 52. The contact circuits 51 are driven in pairs by conventional solenoids and cams. The dots 55 connect the ends 58 of the segments of the detection line 56 when the contact circuit 51 is in one of the two positions. If there is a malfunction in one or more of the switches so that a contact circuit 51 is not in one of the allowed positions, or does not switch, the output of the detection line 56 will indicate this condition. The normal output of the detection line 56 is "make-break-make", but a malfunction results in either a "make-break", or no change from the "make" conditon. The detection line 56 need not be a microstrip conductor since the detection may be done with D.C.

A port switching circuit is shown in FIG. 6 and has a hybrid circuit substrate 60 with short microstrip lines 62 for each port. A contact circuit 61 has contact strips 63 configured to connect adjacent ports.

The present invention encompasses any desired switching function configuration including simple single pole/double throw designs to multi-port designs. Also, slide motion as well as the rotary motion described can be used. To improve life of the switch a lubricant may be used which does not oxidize, such as a number of synthetic oils used in the watch industry. Although microstrip transmission media have been used for illustration, any planar transmission media, such as coplanar and stripline, may be used.

Thus, the present invention provides a microwave switch that switches on a planar transmission media and is effective up to at least 40 GHz.

What is claimed is:

1. An integrated pad switch comprising:

a hybrid circuit substrate having a predetermined conductor pattern representing an electrical circuit;

a flexible substrate in contact with the electrical circuit, the flexible substrate having a predetermined contact pattern covering a portion of the flexible substrate; and means for slidably moving said flexible substrate across the surface of said hybrid circuit substrate so that said predetermined contact pattern changes its relationship to said predetermined conductor pattern to switch the characteristics of said electrical circuit.

2. An integrated pad switch as recited in claim 1 further comprising an elastic block adhesively attached to the back of said flexible substrate.

3. An integrated pad switch as recited in claim 2 wherein said moving means comprises:

a driver adhesively attached to the back of said elastic block; and means for driving said driver so that said flexible substrate moves across the surface of said hybrid cicuit substrate.

4. An integrated pad switch as recited in claim 3 further comprising a non-oxidizing, synthetic lubricant between said flexible substrate and said hybrid circuit substrate to prolong the life of said integrated pad switch.

5. An integrated pad switch as recited in claim 1 wherein said hybrid circuit substrate comprises:

an insulator of a material selected from the group consisting of quartz, glass and sapphire, said insulator substrate having a smooth surface to facilitate the sliding of the flexible substrate across the hybrid circuit substrate;

a ground plane of a conducting material attached to the back of said insulator substrate; and a microstrip line laid on the face of said insulator substrate to form said electrical circuit.

6. An integrated pad switch as recited in claim 1 wherein said predetermined contact pattern comprises a conductive material embedded in said flexible substrate, said flexible substrate being of an organic material, to form a smooth surface for contact with said hybrid circuit substrate.

7. An integrated pad switch as recited in claim 2 wherein said elastic block comprises a material selected from the group consisting of silicone-rubber, polyurethane, cross-linked polyethylene, neoprene, vinyl nitrile, ethylene-vinyl acetate and ensolite, said material having a low dielectric constant.

* * * * *